US006881103B2

(12) United States Patent
Dawidziuk

(10) Patent No.: US 6,881,103 B2
(45) Date of Patent: Apr. 19, 2005

(54) ELECTRICAL CONNECTOR WITH TPA RETENTION

(75) Inventor: Jaroslaw Henryk Dawidziuk, Whitby (CA)

(73) Assignee: Tyco Electronics Canada, Ltd., Markham (CA)

( * ) Notice: Subject to any disclaimer, the term of this patent is extended or adjusted under 35 U.S.C. 154(b) by 0 days.

(21) Appl. No.: 10/463,904

(22) Filed: Jun. 18, 2003

(65) Prior Publication Data

US 2004/0259430 A1 Dec. 23, 2004

(51) Int. Cl.[7] ..... H01R 13/514
(52) U.S. Cl. ..... 439/752
(58) Field of Search ..... 439/752, 595

(56) References Cited

U.S. PATENT DOCUMENTS 5,100,346 A * 3/1992 McCardell ..... 439/595
5,176,537 A * 1/1993 Samejima et al. ..... 439/595
5,292,261 A * 3/1994 Hirano et al. ..... 439/752
5,575,692 A * 11/1996 Cecil et al. ..... 439/752
6,302,735 B1 * 10/2001 Nishide et al. ..... 439/595
6,514,098 B1 * 2/2003 Marpoe et al. ..... 439/352
6,716,069 B1 * 4/2004 Nakamura et al. ..... 439/752

* cited by examiner

*Primary Examiner*—Phuong Dinh

(57) ABSTRACT

An electrical connector is provided that includes a connector housing that receives a terminal contact. The housing includes a deflectable bar and a terminal position assurance (TPA) device. The TPA device is loaded on the housing to engage the bar and is moveable between a staged position and a locked position with respect to the bar. The TPA device includes a beam having a latch that causes the bar to deflect in bending and twisting with respect to the TPA device as the TPA device is loaded. The bar includes a slot that receives the latch when the TPA device moves into the locked position.

20 Claims, 6 Drawing Sheets

ELECTRICAL CONNECTOR WITH TPA RETENTION

BACKGROUND OF THE INVENTION

The invention relates generally to electrical connectors and more particularly to a connector that positively retains a terminal position assurance (TPA) element.

A wide variety of connectors exist for various applications. Certain connectors include terminal position assurance (TPA) elements. The TPA secures terminal contacts within respective contact cavities in the connector. The TPA secures the terminal contact in proper position for electrically mating with the terminal contacts of a mating connector or other electrical component. In addition, the TPA is often designed to hinder or block unintended withdrawal of the terminal contacts. In many connector designs, the TPA itself is entirely removable from the connector, which may, over time, compromise the integrity of the connector.

In the automotive industry, there are applications such as fuel injection systems and the like, in which the TPA locks onto the connector to provide for more secure retention of the terminal contact within the connector. When the TPA locks on to the connector, the terminal contacts are less likely to vibrate out or be inadvertently removed, such as during the servicing of a nearby component or system. An additional latching or clamping mechanism is needed to lock the TPA on the connector which increases the size of the connector.

A need exists for a more compact connector with terminal position assurance features that provides for the retention of the TPA while maintaining the durability and security of a larger connector relative to the retention of the TPA.

BRIEF DESCRIPTION OF THE INVENTION

In one embodiment, an electrical connector is provided that includes a connector housing that receives a terminal contact. The housing includes a deflectable bar and a terminal position assurance (TPA) device. The TPA device is loaded on the housing to engage the bar and is moveable between a staged position and a locked position with respect to the bar. The TPA device includes a beam having a latch that causes the bar to deflect in bending and twisting with respect to the TPA device as the TPA device is loaded. The bar includes a slot that receives the latch when the TPA device moves into the locked position.

In another embodiment, an electrical connector includes an outer body and a terminal housing within the outer body. The terminal housing includes at least one deflectable bar. The bar has a first end fixed with respect to the terminal housing and a second opposite end deflectable with respect to the terminal housing. A TPA device is loaded on the terminal housing and is configured to engage a deflectable contact latch on the terminal housing that engages the contact to retain the contact in the terminal housing.

DETAILED DESCRIPTION OF THE INVENTION

Figure 1:
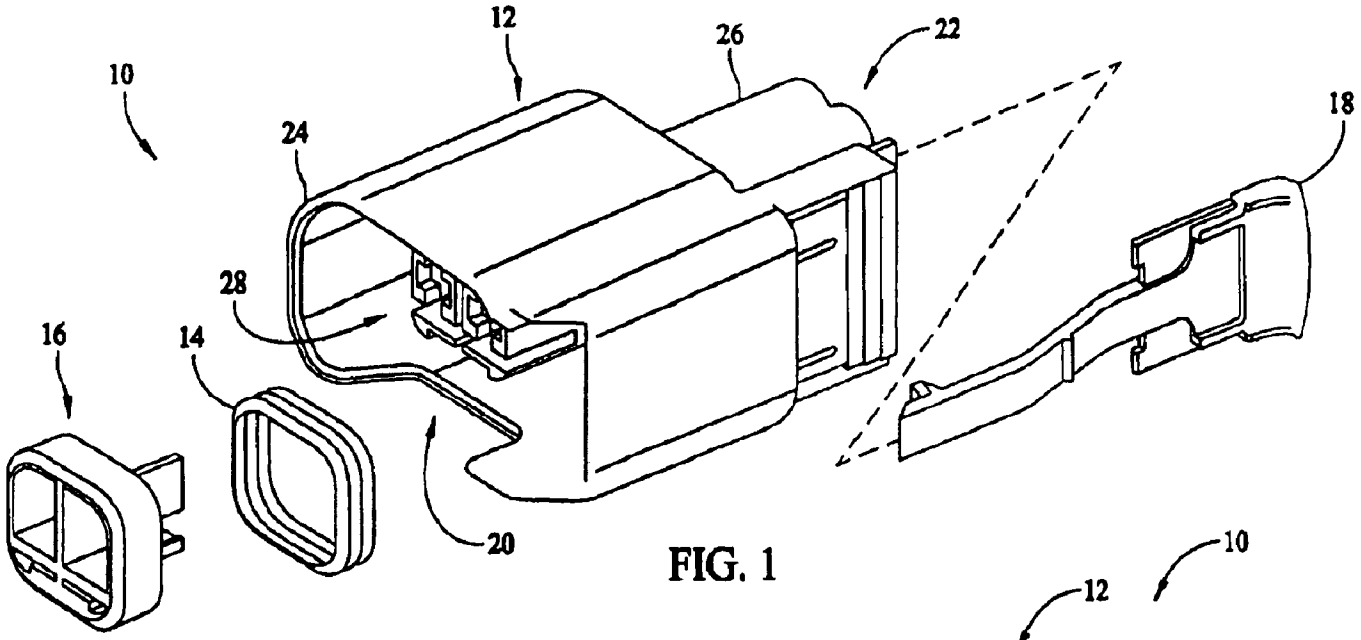
FIG. 1 is an exploded view of an electrical connector formed according to one embodiment of the present invention.

FIG. 1 illustrates a connector 10 that includes a housing 12, a seal 14, and a terminal position assurance (TPA) device 16. Optionally, the connector 10 may also include a connector position assurance (CPA) member 18. The CPA member 18 can be used to more positively engage the connector 10 to a mating connector or electrical device. The housing 12 includes a mating end 20 and a terminal loading end 22. A shroud 24 covers the mating end 20. The connector 10, as illustrated, is a two terminal connector, however, in other embodiments, more or fewer terminal contacts may be employed. The housing 12 also includes a body 26. Shroud 24 is integrally formed with and is an extension of the body 26. The body 26 includes a front end 28 that is recessed within the shroud 24.

Figure 2:
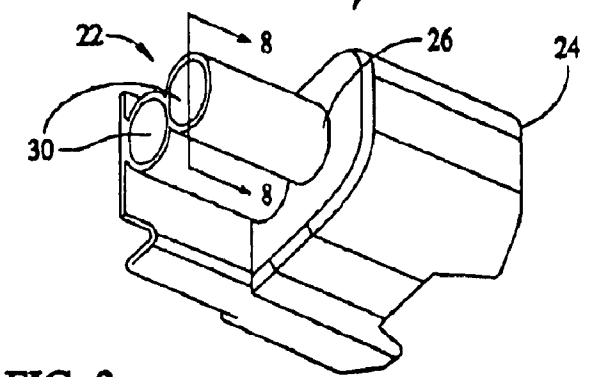
FIG. 2 is a perspective view from the terminal loading end of the connector of FIG. 1.

FIG. 2 illustrates the connector 10 from the terminal loading end 22. Contact cavities 30 extend from the terminal loading end 22 of the body 26 to the front end 28 (see FIG. 1). Terminal contacts (not shown) are loaded into the connector 10 through contact cavities 30 and are retained proximate the front end 28 of body 26 as will be described.

Figure 3:
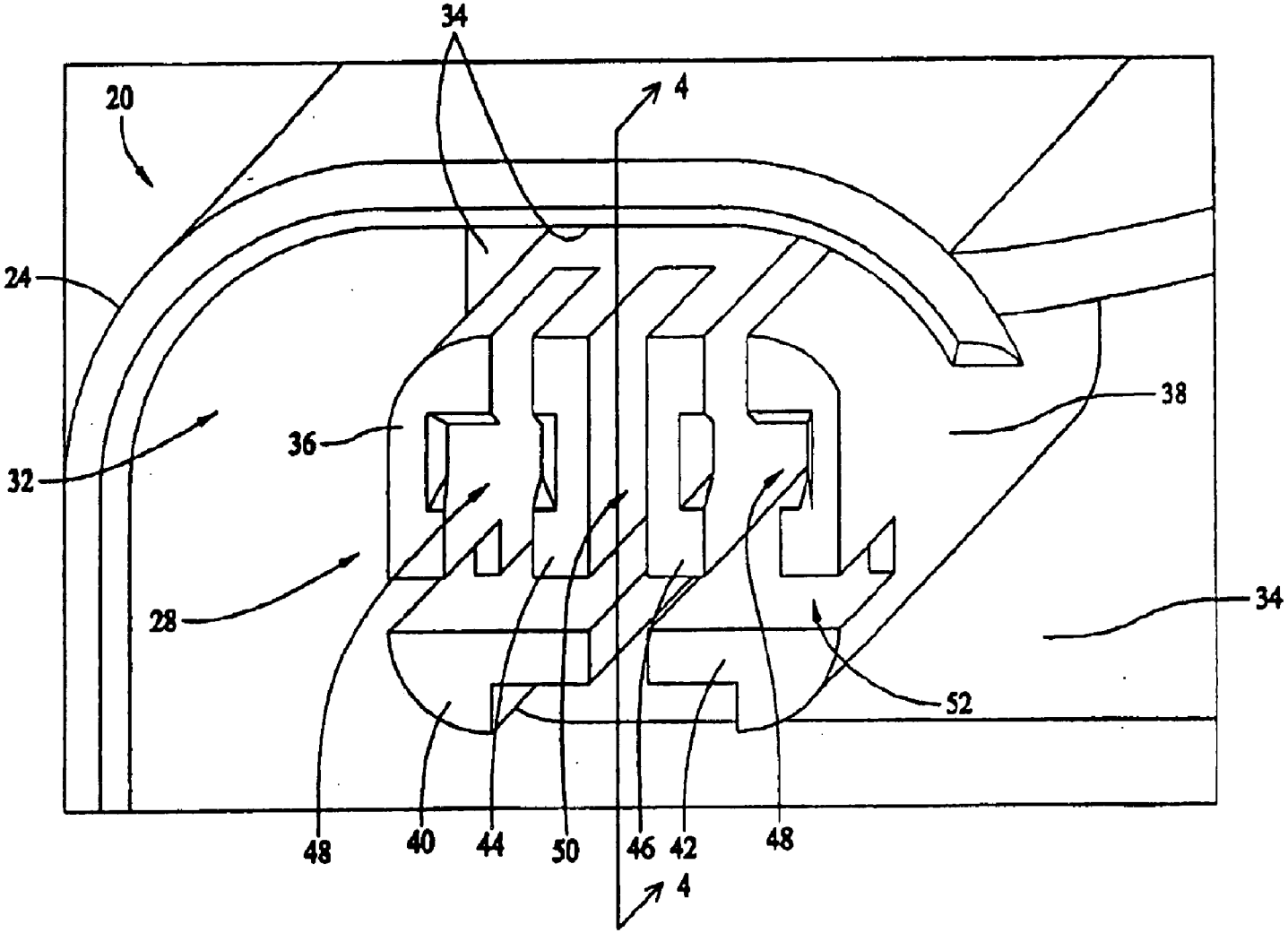
FIG. 3 is a perspective view of the mating end of the connector of FIG. 1.

FIG. 3 illustrates the mating end 20 of the connector 10. The mating end 20 includes a recess 32 within the shroud 24. A sealing surface 34 at the base of the recess 32 surrounds the front end 28 of the body 26. Seal 14 when installed, rests on the sealing surface 34 and encapsulates the front end 28. The front end 28 of the body 26 includes a left side member 36, a right side member 38 and left and right lower sections 40 and 42, respectively. The front end 28 also includes a left deflecting bar 44 and a right deflecting bar 46. The left and right side members 36 and 38, left and right lower sections 40 and 42, and left and right deflecting bars 44 and 46 are formed from molded cutouts in the body 26, and are thus integral with the body 26. The front end 28 also includes a pair of mating terminal entryways 48 each being positioned between deflecting bars 44 and 46 and side member 36 and 38. A vertical TPA channel 50 extends into the interior of the connector body 26 between deflecting bars 44 and 46. A contact retention channel 52 extends horizontally into the body 26 above right and left lower sections 40 and 42, respectively.

Figure 4:
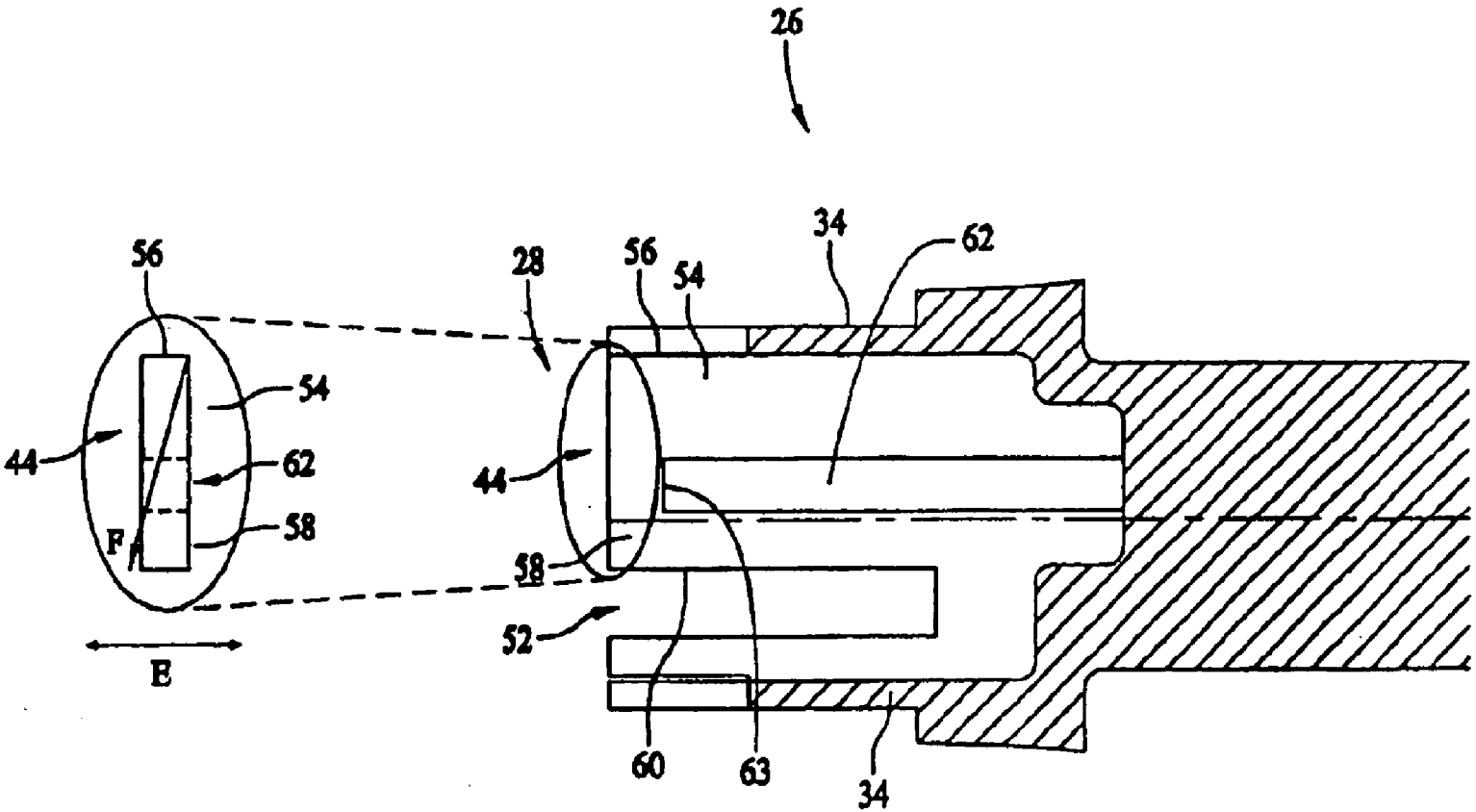
FIG. 4 is a cross-sectional view of the connector body of FIG. 3, taken along the line 4—4 and showing a deflecting bar according in detail.

FIG. 4 is a cross-section of the connector body 26 taken along the section line 4—4 in FIG. 3, through the TPA channel 50, and illustrating deflection bar 44 in detail. It should be noted, that deflection bars 44 and 46 are mirror images of each other. Deflection bar 44 includes a slot 62, an upper portion 54 located generally above the slot 62, and a lower portion 58, generally below the slot 62. Slot 62 includes an engagement face 63 at an end facing the front end 28 of the body 26 which interacts with the TPA 16 as will be described.

The upper portion 54 has an upper edge 56 that is adjacent the sealing surface 34. The lower portion 58 has a lower edge 60. Due to the presence of the sealing surface 34, the upper edge 56 of the deflecting bar 44 has a length $L_1$ that is considerably shorter than a length $L_2$ of the lower edge 60 of the lower portion 58 of the deflecting bar 44. As a result of the longer length $L_2$ of the lower edg 60, lower portion 58 is more flexible than the upper portion 54 of the deflecting bar 44. Consequently, upper portion 54 resists bending to a greater degree than does the lower portion 58 of deflecting bar 44. The increased length $L_2$ of lower edge 60 results from the molded under cut in the body 26 that forms the contact retention channel 52. In one embodiment, the upper edge 56 has a length $L_1$ of 4 millimeters and lower edge 60 has a length $L_2$ of 9 millimeters. The inset in FIG. 4 shows the deflecting bar 44 from the front end 28 and illustrates the movement of the deflecting bar 44 which will be described in detail hereinafter.

Figure 5:
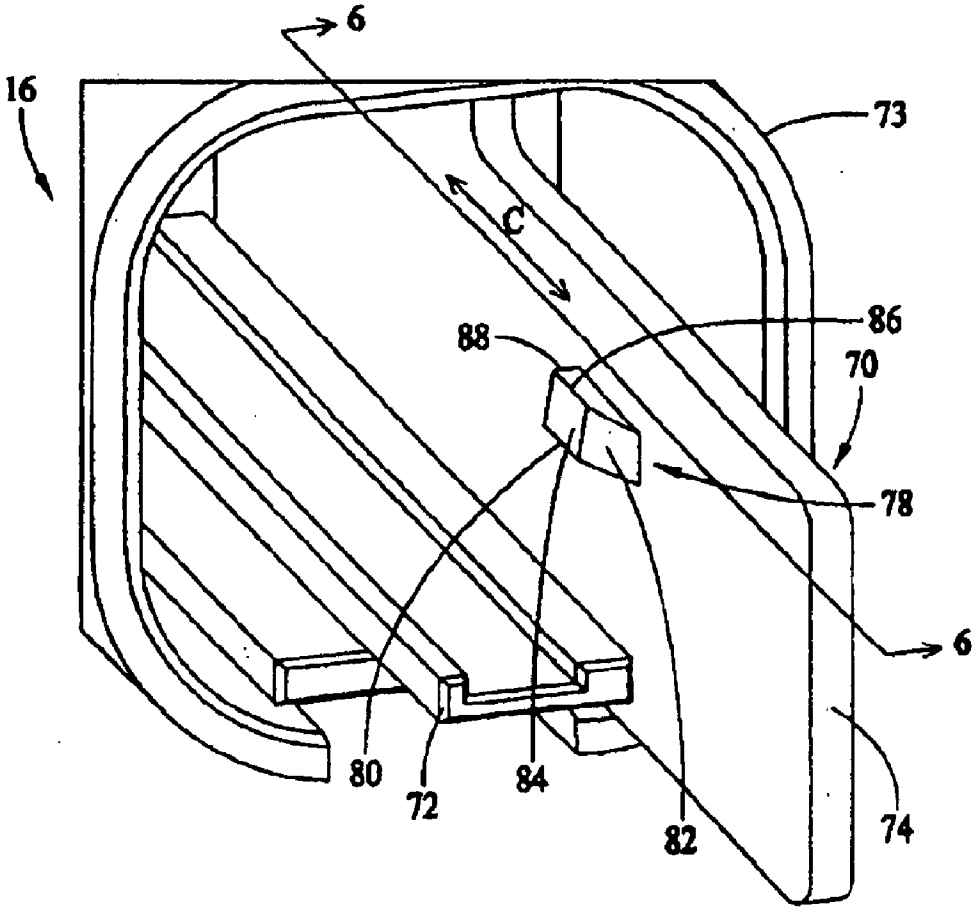
FIG. 5 is a perspective view of the TPA of FIG. 1.

FIG. 5 illustrates the TPA 16 which includes a beam 70, a pair of contact retention supporting blades 72, one on each side of the beam 70, and a shroud 73. The beam 70 includes a leading edge 74 and a pair of contact latches 76, on one side, and 78 on the opposite side (see FIG. 6). Contact latches 76 and 78 each includes a front beveled surface 82, a top side beveled surface 84 and a locking face 88. Contact latches 76 and 78 are displaced from each other with respect to a longitudinal axis C of beam 70 with contact latch 78 being positioned closer to the leading edge 74 of the beam 70. When the TPA 16 is inserted into the connector body 26, contact latches 76 and 78 each engage one of the deflecting bars 44 and 46. The front bevels 82 initiate sideward deflection of one of deflection bars 44 and 46 when the TPA 16 is inserted.

However, due to the difference in the lengths $L_1$ and $L_2$ of the upper edge 56 and the lower edge 60, respectively, of the deflection bars 44 and 46 (see FIG. 4), the upper portion 54 of the deflection bars 44 and 46 cannot deflect as much as the lower portions 58 of the deflection bars 44 and 46. The side bevels 84 of the TPA latches 76 and 78 are constructed such that a lower edge 80 extends laterally further from beam 70 then does an upper edge 86. As a result, the side bevels 84 impart an additional sideward deflection to the lower portion 58 of the deflection bars 44 and 46.

The deflection bars 44 and 46 exhibit both a bending motion in a direction denoted by arrow E (see FIG. 4) and a twisting motion in a direction denoted by arrow F (see FIG. 4) as the TPA 16 is inserted into the connector body 26. The twisting motion resulting from the increased sideward deflection of the lower portion 58 relative to the upper portion 54 of the deflection bars 44 and 46. When the TPA 16 is sufficiently inserted into the body 26, the TPA latches 76 and 78 engage slots 62 in deflection bars 44 and 46. When the TPA latches 76 and 78 are completely within slot 62, the deflection bars 44 and 46 return to their original undeflected positions. In addition, locking faces 88 of latches 76 and 78 engage the ends 63 of slots 62 to inhibit removal of the TPA 16.

TPA latches 76 and 78 are displaced from each other relative to the leading edge 74 of the beam 70 along a length of the beam 70. The displacement is such that latch 78, being closer to the leading edge 74 (see FIG. 6), engages one deflection bar 46, deflects the deflection bar 46, and then enters a slot 62 before latch 76 engages the other deflection bar 44. Thus the deflection bars 44 and 46 are not deflected simultaneously. Once latches 76 and 78 are seated in a slot 62, the latches 76 and 78 are not intended to be withdrawn.

When latch 78 is seated in slot 62 and latch 76 is not seated, the connector 10 is in a staged condition. For example, the TPA 16 is inserted into the connector body 26 but not seated, so that a terminal contact can be loaded into the connector 10. The connector 10 is shipped in this staged condition. The TPA 16 also includes a pair of contact retention supporting blades 72, one on each side of the beam 70.

In FIG. 5, only one contact retention supporting blade 72 is visible. When the TPA 16 is loaded onto the body 26, contact retention supporting blades 72 are received into the contact retention channels 52. When a terminal contact is loaded in the connector 10 and the TPA 16 is seated in connector body 26, contact retention supporting blades 72 inhibit deflection of the arm 92 (see FIG. 8) and removal of the terminal contact as will be described hereinafter.

Figure 6:
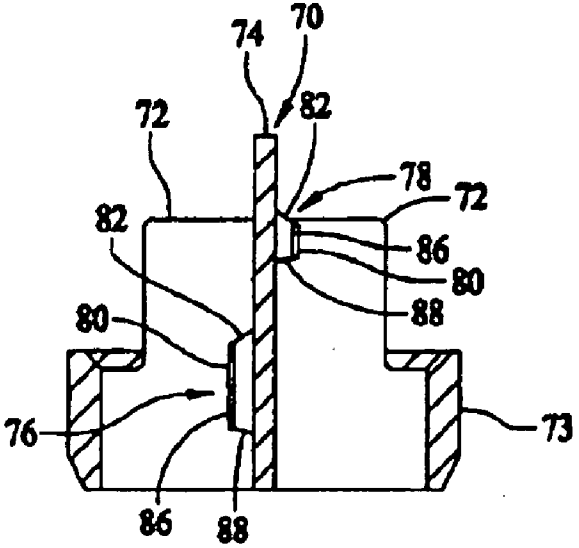
FIG. 6 is a cross-sectional view of the TPA of FIG. 5, taken along the line 6—6.

FIG. 6 is a cross-sectional view of the TPA 16 taken through line 6—6 in FIG. 5 to more clearly show the relationship of the latches 76 and 78 to each other. In FIG. 6, latch 78 being closer to the leading edge 74 of the beam 70 will be the first to engage and seat in a deflection bar 44, 46. Latch 78 will also be seated in the slot 62 of a deflection bar 44, 46 when the connector is in a staged or as shipped condition.

Figure 7:
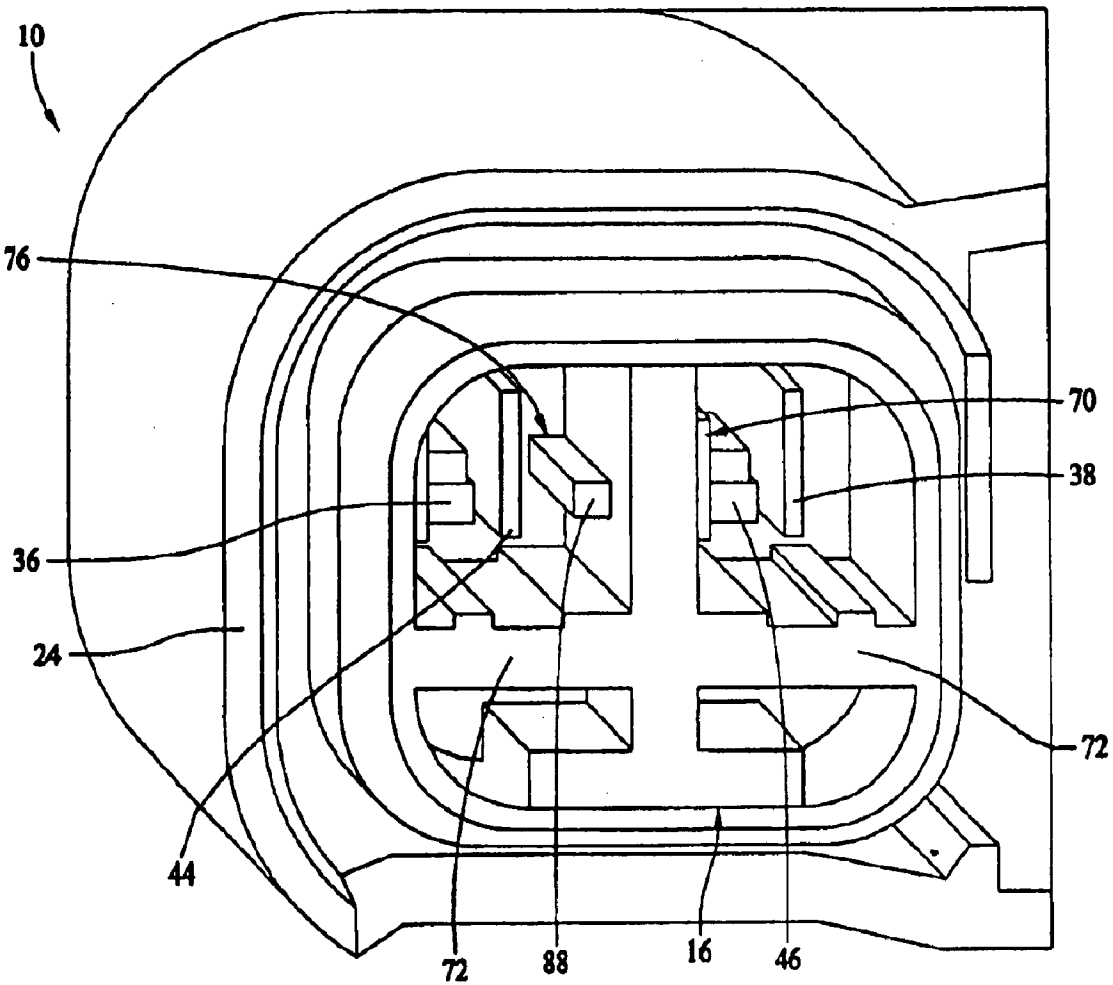
FIG. 7 is a perspective view of the connector of FIG. 1 in a staged, or as shipped condition.

FIG. 7 illustrates the connector 10 in a staged or as shipped condition. As shown, the TPA 16 is partially inserted into the connector body 26. In FIG. 7, only the left side TPA latch 76 is visible. The right side TPA latch 78 (see FIG. 6) is positioned closest to the TPA beam leading edge 74 and is seated in the slot 62 of the right deflection bar 46. In this condition, the locking face 88 of the right side TPA latch 78 has engaged end 63 of the slot 62 in the deflection bar 46 so that the TPA 16 cannot easily be removed. However, the TPA 16 is not in its final seated position so that a contact terminal can be installed and locked into the connector 10 when the connector 10 is ready for use.

Figure 8:
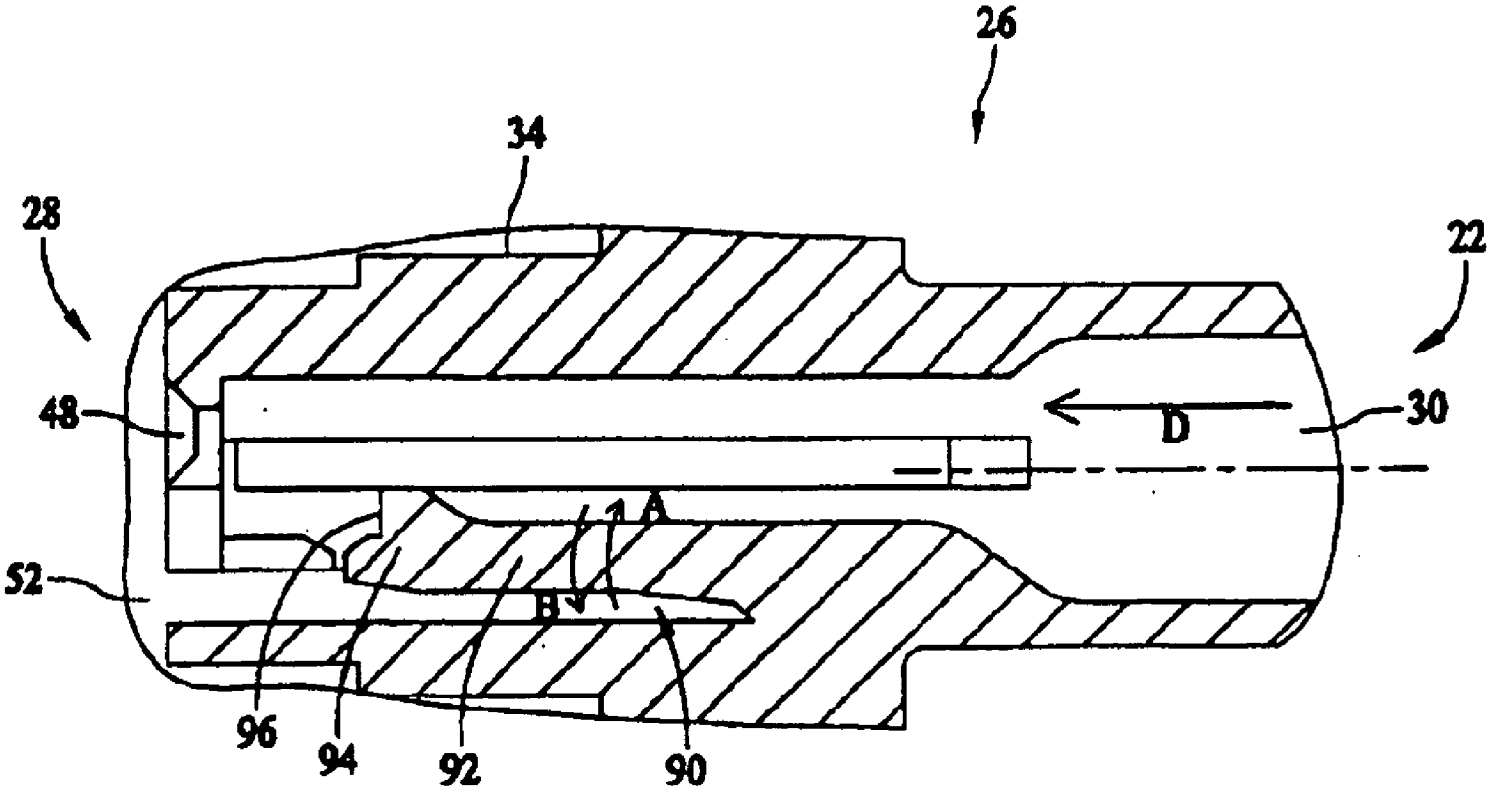
FIG. 8 is a cross sectional view of the connector body of FIG. 2, taken along the line 8—8.

FIG. 8 illustrates an enlarged cross-section of the connector body 26 taken through section line 8—8 of FIG. 2, through the contact cavity 30. Contact cavity 30 is shown extending from the terminal loading end 22 of the connector 10 to the terminal entryway 48 at the front end 28 of the body 26. The body 26 includes a contact retention member 90 that is integrally formed with the body 26 and includes an arm 92 that extends toward the front end 28 of the body 26. A contact latch 94 is formed at the end of arm 92 facing the front end 28 of the body 26. The arm 92 is deflectable as indicated by the arrows A and B. Deflection in the direction of arrow A moves the contact latch 94 into the contact cavity 30 while deflection in the direction of arrow B moves the contact latch 94 away from the contact cavity 30 and into the contact retention channel 52. Contact latch 94 is biased in a position partially extending into the contact cavity 30 so as to interfere with the insertion of a terminal contact.

When a contact (not shown) is loaded (in the direction of arrow D), the contact engages the contact latch 94 causing the arm 92 to deflect in the direction of arrow B away from the cavity 30. Upon further insertion of the contact, the contact passes the contact latch 94 so that the arm 92 moves upward in the direction of arrow A returning the contact latch 94 to a biased position partially extending into the contact cavity 30. The contact latch has an engagement face 96 that is received in a complimentarily shaped recess in the contact such that the contact cannot be withdrawn unless the arm 92 is deflected away from the contact cavity 30 as occurred during the insertion of the contact. Arm 92, when deflected downward in the direction of arrow B to allow passage of the contact, becomes an obstruction in the contact retention channel 52.

If a contact is left in a partially inserted condition, arm 92 remains deflected in the direction of arrow B into the contact retention channel 52 such that the blade 72 of the TPA 16 is inhibited from entering the channel 52, thereby inhibiting the complete insertion of the TPA 16. When the contact is fully inserted, arm 92 moves upward in the direction of arrow A, returning the contact latch 94 to the biased position whereby the contact retention channel 52 is unobstructed. Blade 72 can then enter retention channel 52 thus allowing full insertion of the TPA 16 and thus demonstrating the terminal position assurance feature of the connector 10.

Once the TPA 16 is completely inserted, both TPA latches 76 and 78 will seat in a respective slot 62 of a deflection bar 44, 46. Once both latches 76 and 78 are seated, removal of the TPA 16 is inhibited by interference of the locking face 88 of latch 76 (closest to mating end 20) with the engagement face 63 of the deflection bar slot 62, thus demonstrating the TPA retention feature of the connector 10. When the TPA 16 is fully seated in the body 26, blade 72 is also seated in position beneath arm 92 which inhibits downward deflection of arm 92 in the direction of arrow B inhibiting removal of the terminal contact. Thus, the connector 10 also provides positive contact retention.

The embodiments thus described provide a connector with terminal position assurance and contact retention support that is particularly suited for use in automotive electronically controlled fuel injection systems. The combined bending and twisting movement of the deflection bars allows the use of a larger TPA latch without cracking the deflection bars, thus providing the security of a larger connector in a more compact package.

While the invention has been described in terms of various specific embodiments, those skilled in the art will recognize that the invention can be practiced with modification within the spirit and scope of the claims.

What is claimed is:

1. An electrical connector comprising:

a housing configured to receive a contact, said housing including a deflectable bar, said bar including a first edge having a first length and a second edge having a second length greater than said first length, said first and second length cooperating to facilitate twisting of said bar; and a terminal position assurance (TPA) device loaded on said housing to engage said bar, said TPA device being moveable between a staged position and a locked position with respect to said bar, said bar being deflectable with respect to said TPA device when said TPA device is loaded on said housing.

2. The connector of claim 1 wherein said TPA device includes a beam, said beam slidably engaging said bar when said TPA device is loaded on said housing.

3. The connector of claim 1 wherein said TPA device includes a latch, said latch including a first bevel and a second bevel, said first and second bevels cooperating to twist and bend said bar in first and second directions with respect to a length of said bar as said TPA device is loaded on said housing.

4. The connector of claim 1 wherein said TPA device moves along a TPA axis between said initial and final positions, and said bar twists and bends in different directions with respect to said TPA axis.

5. The connector of claim 1 wherein said bar has opposed top and bottom edges that deflect different distances as said TPA device is loaded on said housing.

6. The connector of claim 1 wherein said TPA device includes a planar beam extending along a longitudinal TPA axis, said beam including a first latch provided on one side thereof offset with respect to said longitudinal axis.

7. The connector of claim 1 wherein said TPA device includes a planar beam extending along a longitudinal TPA axis, said beam including first and second latches on opposite sides thereof, said first and second latches offset from each other with respect to said longitudinal axis.

8. The connector of claim 1 wherein said TPA device includes a beam having a leading edge facing said housing, and first and second latches on opposite sides thereof, said latches being spaced different distances from said leading edge.

9. The connector of claim 1 wherein said TPA device further comprises a beam and a contact retention supporting blade formed with said beam and extending along at least one side of said beam.

10. The connector of claim 1 wherein said housing includes first and second bars with a gap therebetween, said beam received in said gap, said beam including a first latch element engaging said first bar when said TPA device is in said initial position and said beam including a second latch element engaging said second bar when said TPA is in said final position.

11. An electrical connector comprising:

an outer body;

a terminal housing within said outer body, said terminal housing including at least one deflectable bar, said bar including a first edge having a first length and a second edge having a second length greater than said first length said first and second lengths cooperating to facilitate twisting of said bar; and a TPA device loaded on said terminal housing and configured to engage a contact latch that retains an electrical contact in said terminal housing.

12. The connector of claim 11 wherein said TPA device includes a beam, said beam being slidably engaged to said bar when said TPA device is loaded on said housing.

13. The connector of claim 11 wherein said TPA device includes a latch, said latch including a first bevel and a second bevel, said first and second bevels cooperating to twist and bend said bar with respect to a length of said bar as said TPA device is loaded on said housing.

14. The connector of claim 11 wherein said bar defines a longitudinally extending slot and said TPA device includes a beam having a latch thereon, said latch being receivable in said slot as said TPA device is loaded on said housing.

15. The connector of claim 11 wherein said TPA device comprises a beam and a contact retention supporting blade formed with said beam and extending along at least one side of said beam, said contact retention supporting blade configured to retain an electrical contact in said housing.

16. An electrical connector comprising:

a housing configured to receive a contact, said housing including first and second bars defining a channel therebetween, said channel having open upper and lower ends; and a terminal position assurance (TPA) device loaded on said housing, said TPA device being moveable between a staged position and a locked position with respect to said bars, said TPA device including a beam received in said channel, said beam including a first latch element engaging said first bar when said TPA device is in said staged position and a second latch element engaging said second bar when said TPA device is in said locked position, and wherein said bars twist and bend with respect to said beam when said TPA is loaded on said housing.

17. The connector of claim 16 wherein said TPA device comprises a beam and a contact retention supporting blade formed with said beam and extending along at least one side of said beam, said contact retention supporting blade configured to retain an electrical contact in said housing.

18. The connector of claim 16 wherein said first and second latches are on opposite sides of said beam and offset from each other with respect to a longitudinal axis of said beam.

19. The connector of claim 16 wherein said first and second bars include opposed first and second edges having portions extending from said housing, wherein a greater portion of said first edges extend from said housing than said second edges.

20. An electrical connector comprising:

a housing configured to receive a contact, said housing including a deflectable bar; and a terminal position assurance (TPA) device loaded on said housing, said TPA device including a latch having a first bevel and a second bevel to engage said bar, said TPA device being moveable between a staged position and a locked position with respect to said bar, said first and second bevels deflecting said bar with respect to said TPA device when said TPA device is loaded on said housing.

* * * * *